US005135826A

United States Patent [19]

Ritt et al.

[11] Patent Number: 5,135,826

[45] Date of Patent: Aug. 4, 1992

[54] METHOD OF ELECTROPHOTOGRAPHICALLY MANUFACTURING A LUMINESCENT SCREEN ASSEMBLY FOR A CRT USING AN IMPROVED PLASTICIZER FOR A PHOTOCONDUCTIVE LAYER

[75] Inventors: Peter M. Ritt, East Petersburg; Harry R. Stork, Adamstown, both of Pa.; Pabitra Datta, Cranbury, N.J.

[73] Assignee: RCA Thomson Licensing Corp., Princeton, N.J.

[21] Appl. No.: 692,967

[22] Filed: Apr. 29, 1991

Related U.S. Application Data

[63] Continuation of Ser. No. 495,002, Mar. 12, 1990, abandoned.

[51] Int. Cl.[5] ..... G03G 13/22; G03C 5/00

[52] U.S. Cl. ..... 430/28; 427/64; 427/68; 427/31

[58] Field of Search ..... 430/28; 427/64, 68

[56] References Cited

U.S. PATENT DOCUMENTS

| | | | |
|---|---|---|---|
| 3,067,055 | 12/1962 | Saulnier, Jr. . | |
| 3,475,169 | 10/1969 | Lange . | |
| 3,489,556 | 1/1970 | Drozd . | |
| 3,489,557 | 1/1970 | Lange et al. . | |
| 4,327,168 | 4/1982 | Hashimoto | 430/57 |
| 4,508,805 | 4/1985 | Kawamura | 430/58 X |
| 4,657,961 | 4/1987 | Nishizawa et al. | 524/297 |
| 4,921,767 | 5/1990 | Datta et al. | 430/23 |

FOREIGN PATENT DOCUMENTS

| | | |
|---|---|---|
| 380279 | 8/1990 | European Pat. Off. . |
| 403263 | 12/1990 | European Pat. Off. . |
| 49-038315 | 10/1974 | Japan . |
| 54-130936 | 10/1979 | Japan . |
| 2103638 | 2/1983 | United Kingdom . |

*Primary Examiner*—Roland Martin

*Attorney, Agent, or Firm*—Joseph S. Tripoli; Dennis H. Irlbeck; Vincent J. Coughlin, Jr.

[57] ABSTRACT

The method of electrophotographically manufacturing a luminescent screen assembly on a substrate for use within a CRT, according to the present invention, includes the steps of: forming a conductive layer on the substrate; overcoating the conductive layer with a photoconductive solution comprising an organic polymeric material, a suitable photoconductive dye, a plasticizer and a solvent to form a photoconductive layer; and, then, establishing an electrostatic charge on the photoconductive layer. Selected areas of the photoconductive layer are exposed to visible light to affect the charge thereon, and the photoconductive layer is developed with charged screen structure material. The improved method utilizes a dialkyl phthalate plasticizer which is selected from the group consisting of dibutylphthalate (DBP), dioctylphthalate (DOP), and diundecylphthalate (DUP).

2 Claims, 2 Drawing Sheets

DEPOSIT
34
32
18

D.C. Volts
36
CHARGE
34
32
18

38
40
25
EXPOSE
34
32
18

Phosphors or Black Matrix
DEVELOP
18
32
34
42

FUSE
23
22
34
32
18
44

FIX
18
32
34
22
23
46
48

METHOD OF ELECTROPHOTOGRAPHICALLY MANUFACTURING A LUMINESCENT SCREEN ASSEMBLY FOR A CRT USING AN IMPROVED PLASTICIZER FOR A PHOTOCONDUCTIVE LAYER

This is a continuation of application Ser. No. 495,002, filed Mar. 12, 1990, now abandoned.

The present invention relates to a method of electrophotographically manufacturing a luminescent screen assembly and, more particularly, to a method in which an improved plasticizer is utilized with a photoconductive layer to minimize the cracking of the layer.

BACKGROUND OF THE INVENTION

U.S. Pat. No. 3,475,169, issued to Lange on Oct. 28, 1969, discloses a process of electrophotographically screening color cathode-ray tubes by applying, over the image area, a conductive layer and a superimposed photoconductive layer preferably formed of a resin. A latent charge image is established on the photoconductive layer and then a developer is applied over the image area. The developer includes phosphor particles as well as a binder in a carrier liquid. Preferably, the binder is formed of the same resin as that included in the photoconductive layer and the resin encapsulates the phosphor particles. The application of the developer selectively deposits phosphor particles to develop the latent image and thereafter the excess developer is removed and the image dried. For a color screen, this same general process is carried out three times, once for each of the three color-emitting phosphors. The photoconductive layer tends to be hard and brittle so it is known to add a plasticizer, such as Piccolastic A-75 (a polymerized styrene homologue) or Piccoumaron 410-L (a terpene compound), each of which is a product of Pennsylvania Industrial Chemical Corp., to prevent cracking of the photoconductive layer and subsequent misregister of the phosphors. Alternatively, Plastolein 9066 LT (di-2-ethyl hexyl adipate), a product of Emery Industries, Inc. may be used. Using either of the two former-named materials, the ratio of plasticizer to resin (PVK, i.e., polyvinyl carbazole) is 1:1; whereas, for the latter-named material the plasticizer comprises about 13.3 weight percent of the resin. Plastolein 9066 LT is disclosed in U.S. Pat. No. 3,489,556 issued to Drozd on Jan. 13, 1970, and in U.S. Pat. No. 3,489,557 issued to Lange et al on Jan. 13, 1970.

U.S. Pat. No. 4,921,767, issued on May 1, 1990 to Datta et al., discloses a "dry" process for forming a CRT screen assembly. The "dry" process utilizes triboelectrical charged dry phosphor particles rather than phosphor particles suspended in a carrier liquid. The "dry" triboelectrically-charged phosphor develops the latent charge image formed on the photoconductive layer. The "dry" process requires fewer processing steps and is, therefore, more efficient than the Lange process. The initial steps in the "dry" process are similar to those described in the Lange patent in that a conductive layer and an overlying photoconductive layer are formed in the image area of the screen and a latent charge image is formed on the photoconductive layer. In the process disclosed in U.S. Pat. No. 4,921,767, op. Cit., the photoconductive layer does not contain a plasticizer because the aforementioned plasticizers (or their equivalents) are not capable of providing the critical electrical parameters of charge acceptance, light and dark decay rates, and light sensitivity without degradation, in the concentration of plasticizer necessary to prevent cracking of the PVK-based photoconductive layer.

SUMMARY OF THE INVENTION

In accordance with the present invention, a method of electrophotographically manufacturing a luminescent screen assembly on a substrate for use within a CRT includes the steps of forming a conductive layer on the substrate, overcoating the conductive layer with a photoconductive layer, establishing an electrostatic charge on the photoconductive layer and exposing selected areas of the photoconductive layer to visible light to affect the charge thereon. Then, the photoconductive layer is developed with charged screen structure material. The improved process improves the integrity of the photoconductive layer by adding a dialkyl phthalate plasticizer selected from the group consisting of dibutylphthalate (DBP), dioctylphthalate (DOP), and diundecylphthalate (DUP).

Figure 1:
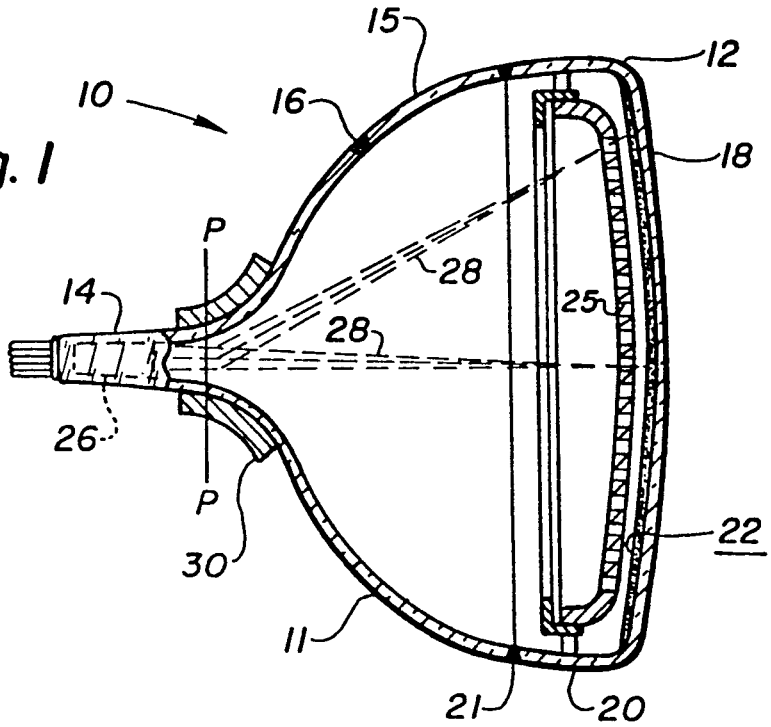
FIG. 1 is a plan view, partially in axial section, of a color cathode-ray tube made according to the present invention.

FIGS. *3a–3f* show selected steps in the manufacturing of the tube shown in FIG. 1.

DETAILED DESCRIPTION OF THE PREFERRED EMBODIMENT

Generally, the details of the novel method are similar to those of the method described in the previously cited U.S. Pat. No. 4,921,767, op. cit., except for the composition of the photoconductive layer. That patent application is incorporated by reference herein for the purpose of disclosure.

Figure 2:
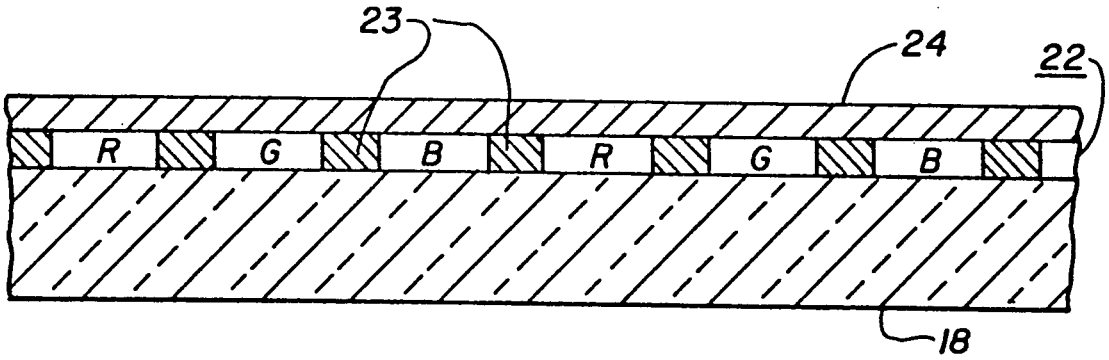
FIG. 2 is a section of a screen assembly of the tube shown in FIG. 1.

Briefly, FIG. 1 shows a color CRT 10 having a glass envelope 11 comprising a rectangular faceplate panel 12 and a tubular neck 14 connected by a rectangular funnel 15. The funnel 15 has an internal conductive coating (not shown) that contacts an anode button 16 and extends into the neck 14. The panel 12 comprises a viewing faceplate or substrate 18 and a peripheral flange or sidewall 10, which is sealed to the funnel 15 by a glass frit 21. A three color phosphor screen 22 is carried on the inner surface of the faceplate 18. The screen 22, shown in FIG. 2, preferably is a line screen which includes a multiplicity of screen elements comprised of red-emitting, green-emitting and blue-emitting phosphor stripes R, G and B, respectively, arranged in color groups or picture elements of three stripes or triads in a cyclic order and extending in a direction which is generally normal to the plane in which the electron beams are generated. In the normal viewing position for this embodiment, the phosphor stripes extend in the vertical direction. Preferably, the phosphor stripes are separated from each other by a light-absorptive matrix material 23, as is known in the art. Alternatively, the screen can be a dot screen. A thin conductive layer 24, preferably of aluminum, overlies the screen 22 and provides a means for applying a uniform potential to the screen as well as reflecting light, emitted from the phosphor elements, through the faceplate 18. The screen 22 and the overlying aluminum layer 24 comprise a screen assembly.

With respect again to FIG. 1, a multi-apertured color selection electrode or shadow mask 25 is removably mounted, by conventional means, in predetermined spaced relation to the screen assembly. An electron gun 26, shown schematically by the dashed lines in FIG. 1, is centrally mounted within the neck 14, to generate and direct three electron beams 28 along convergent paths, through the apertures in the mask 25, to the screen 22. The gun 26 may be, for example, a bi-potential electron gun of the type described in U.S. Pat. No. 4,620,133, issued to Morrell et al. on Oct. 28, 1986, or any other suitable gun.

The tube 10 is designed to be used with an external magnetic deflection yoke, such as yoke 30, located in the region of the funnel-to-neck junction. When activated, the yoke 30 subjects the three beams 28 to magnetic fields which cause the beams to scan horizontally and vertically in a rectangular raster over the screen 22. The initial plane of deflection (at zero deflection) is shown by the line P-P in FIG. 1, at about the middle of the yoke 30. For simplicity, the actual curvatures of the deflection beam paths in the deflection zone are not shown.

Figures 3A, 3B, 3C, 3D, 3E, 3F:
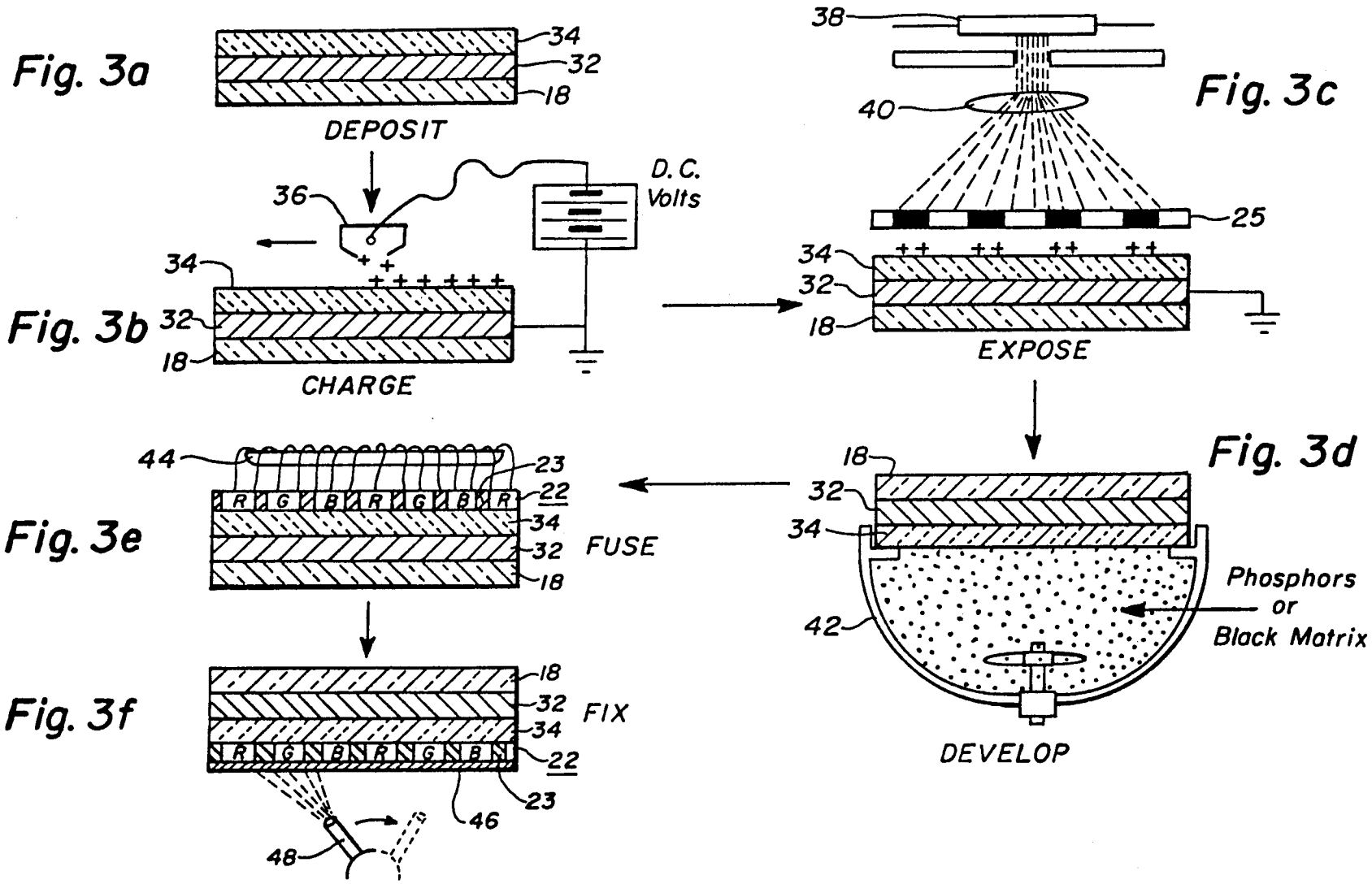

The screen 22 is manufactured by a novel electrophotographic process that is schematically represented In FIGS. 3*a* through 10 3*f*. Initially, the panel 12 is washed with a caustic solution, rinsed with water, etched with buffered hydrofluoric acid and rinsed once again with water, as is known in the art. The inner surface of the viewing faceplate 18 is then coated with a layer 32 of a suitable electrically conductive material which provides an electrode for an overlying photoconductive layer 34. The resultant structure is shown in FIG. 3*a*. The photoconductive layer 34 comprises a solution of a volatilizable organic polymeric material, a suitable photoconductive dye sensitive to visible light, a novel plasticizer, for a purpose to be described hereinafter, and a solvent. The composition and method of forming one formulation of the conductive layer 32 is described in U.S. Pat. No. 4,921,767, op. cit.

The photoconductive layer 34, overlying the conductive layer 32, is charged in a dark environment by a conventional positive corona discharge apparatus 36, schematically shown in FIG. 3*b*, which moves across the layer 34 and charges it within the range of +200 to +700 volts, +300 to +600 volts being preferred. The shadow mask 25 is inserted into the panel 12, and the positively-charged photoconductor is exposed, through the shadow mask, to the light from a xenon flash lamp 38 disposed within a conventional lighthouse (represented by lens 40 of FIG. 3*c*). After each exposure, the lamp is moved to a different position, to duplicate the incident angle of the electron beams from the electron gun. Three exposures are required, from three different lamp positions, to discharge the areas of the photoconductor where the light-emitting phosphors subsequently will be deposited to form the screen. After the exposure step, the shadow mask 25 is removed from the panel 12, and the panel is moved to a first developer 42 (FIG. 3*d*). The first developer contains suitably prepared dry-powdered particles of a light-absorptive black matrix screen structure material. The black matrix material is triboelectrically charged, e.g., negatively, and expelled from the developer 42 and attracted to the positively-charged, unexposed area of the photoconductive layer 34 to directly develop that area.

The photoconductive layer 34, containing the matrix 23, is uniformly recharged to a positive potential of about 200 to 400 volts, for the application of the first of three triboelectrically charged, dry-powdered, surface treated, color-emitting phosphor screen structure materials, which are manufactured by the processes described in copending U.S. patent application, Ser. No. 287,355 and filed by P. Datta et al. on Dec. 21, 1988, and U.S. Pat. No. 4,921,767, op. cit., each of which relates to the surface treatment of phosphor particles. Preferably, the phosphor particles are positively-charged. The shadow mask 25 is reinserted into the panel 12, and selected areas of the photoconductive layer 34, corresponding to the locations where green-emitting phosphor material will be deposited, are exposed to visible light from a first location within the lighthouse to selectively discharge the exposed area. The first light location approximates the convergence angle of the green phosphor-impinging electron beam. The shadow mask 25 is removed from the panel 12, and the panel is moved to a second developer 42. The positively-charged green-emitting phosphor particles are expelled from the developer, repelled by the positively-charged areas of the photoconductive layer 34 and matrix 23, and deposited onto the discharged, light exposed areas of the photoconductive layer, in a process known as reversal developing.

The process of charging, exposing and developing is repeated for the dry-powdered, blue- and red-emitting, surface-treated phosphor particles of screen structure material. The exposure to visible light, to selectively discharge the positively-charged areas of the photoconductive layer 34, is made from a second and then from a third position within the lighthouse to approximate the convergence angles of the blue phosphor- and red phosphor-impinging electron beams, respectively.

The matrix material and phosphors are attached to the photoconductive layer 34 by thermal or vapor bonding. The vapor bonding step is graphically represented in FIG. 3*e*, and is described in U.S. Pat. No. 4,917,978, issued to Ritt et al., on Apr. 17, 1990. Subsequently, the resultant structure is fixed, to further minimize displacement of the screen structure materials, as shown in FIG. 3*f* and as described in the above-referenced U.S. patent application Ser. No. 299,507. The structure is then filmed and aluminized as is known in the art. The faceplate panel 12 is baked in air at a temperature of 425° C. for about 30-60 minutes to drive off the volatilizable constituents of the screen, including the conductive layer 32, the photoconductive layer 34, and the solvents present in both the screen structure and filming materials.

The novel photoconductive layer 34 is prepared by forming a photoconductive control solution comprised of about 3.0 to 7.0 but preferably about 5.0 weight percent of a volatilizable polymeric material, such as polyvinyl carbazole (PVK); about 0.1 to 0.4, but preferably about 0.2 weight percent, relative to the PVK, of a dye sensitive to visible light, such as ethylene violet; about 0.001 weight percent, relative to the PVK, of a suitable leveling agent such as Silar-100, marketed by (Silar Laboratories, Scotia, N.Y.), and the balance, about 95 weight percent, a solvent such as chlorobenzene. The solution is mixed thoroughly and filtered through a 1 micron filter. The viscosity of the control solution is 65 cps. To this control solution is added a suitable quantity of a plasticizer so that the concentration of the plasticizer ranges from 5 to 30 weight percent of the PVK. The viscosity of the plasticized control solution is adjusted to a viscosity of 45 cps by the addition of an additional quantity of the solvent. The preferred plasticizer is a dialkyl phthalate such as dibutylphthalate (DBP), dioctylphthalate (DOP), or diundecylphthalate (DUP).

By way of example, a control solution useful in determining the electrostatic properties of photoconductive layers having different concentrations of plasticizers has the following formulation:

| Ingredient | Weight (grams) |
|---|---|
| Polyvinyl carbazole (PVK) | 200.0 |
| Ethylviolet | 0.4 |
| Silar-100 | 0.2 |
| Chlorobenzene | 3800.0 |

and the voltage, Vr, was read at the end of the 90 second hold time. The charged panel was then exposed to the light from a xenon flash lamp operated at 570 volts, 430 microfarads, and a pulse width of 1 millisecond. The voltage on the panel was remeasured after the initial lamp flash, and the number of flashes required to reduce the panel voltage to 10% of the voltage remaining after the 90 second dark hold, Vr, also was recorded. The panel was then held for 48 hours, at room temperature and at 75% RH, and visually evaluated for cracks in the photoconductive layer. Several of the panels that exhibited no cracks in the photoreceptor (i.e., conductive layer 32 and photoconductive layer 34) were then screened, filmed and reexamined. The results are summarized in the TABLE.

TABLE

| | | | Changing Evaluation 48 cm EPS. System | | | | | Photoreceptor cracking | |
|---|---|---|---|---|---|---|---|---|---|
| | | | | | | Volts after exposure to Xenon flash | | After 48 hrs | After |
| Sample No. | Plasticizer | Plasticizer (wt %) | Initial Volts (Vi) | Volts 90 sec (Vr) | Dark decay (V/s) | 1 | # flashed to 1/10 Vr | at 75% RH | filming process |
| 1 | None | — | 590 | 470 | 1.3 | 90 | 2 | yes | yes |
| 2 | DOP | 5 | 550 | 410 | 1.6 | 85 | 2 | yes | — |
| 3 | DOP | 10 | 570 | 430 | 1.6 | 105 | 3 | no | — |
| 4 | DOP | 20 | 550 | 390 | 1.8 | 120 | 3 | no | no |
| 5 | DOP | 30 | 500 | 320 | 2 | 135 | 4 | no | no |
| 6 | DUP | 10 | 590 | 460 | 1.4 | 95 | 2 | no | — |
| 7 | DUP | 20 | 540 | 405 | 1.5 | 110 | 3 | no | no |
| 8 | DBP | 10 | 470 | 308 | 1.8 | 120 | 3 | no | — |
| 9 | DBP | 20 | 420 | 240 | 2 | 120 | 4 | no | — |
| 10 | Plastolein-9066 | 10 | 320 | 140 | 2 | 80 | 6 | yes | — |
| 11 | same | 20 | 150 | 60 | 1 | No light sensitivity | | no | — |
| 12 | Plastolein-9058 | 10 | 120 | 30 | 1 | No light sensitivity | | yes | — |
| 13 | Cumar-21 | 10 | 670 | 590 | 0.9 | 230 | 5 | yes | — |
| 14 | Cumar-21 | 20 | 720 | 650 | 0.9 | 325 | 8 | yes | — |

The electrostatic properties of different photoconductive layers, with and without plasticizers, were determined by applying a photoconductive solution to 48 cm (19 in) faceplate panels that previously had been coated with a suitable organic conductor having a thickness of about 1 micron to form the layer 32. Fourteen samples were evaluated; one sample contained a photoconductive layer 34 without a plasticizer, and the other thirteen samples comprised four classes of plasticizers having plasticizer concentrations ranging from 5 to 30 weight percent of the PVK used in the control solution The plasticized photoconductive solutions were made as follows: to 200 grams of the photoconductive control solution was added a known weight percent of a plasticizer. The viscosity of the plasticized photoconductive solution was adjusted to 45 cps and coated on a 48 cm faceplate panel to form a 3 to 4 micron thick layer 34 overlying the layer 32.

The electrostatic properties of the photoconductive layer that are of interest include the initial electrostatic surface voltage acceptance, (Vi), of the coated panel, the voltage remaining, Vr, after the panel is held in the dark for a given period of time, s, and the rate of dark decay (V/s where V=Vi−Vr). The tests were conducted by charging each panel with the charging apparatus 36, which was operated at a positive voltage of 9.5 kV and a current of 74 microamperes (μA). Each panel was charged for 30 seconds in an ambient atmosphere of 21° C. and 68% RH. The initial voltage, Vi, was measured and the panel was held in the dark for 90 seconds Sample 1 was a control sample in which no plasticizer was added to the control solution. While the initial charge acceptance of the photoconductive layer 34 to the charge provided by the apparatus 36 was good (Vi=590 volts), the charge remaining on the photoconductive layer after being held in the dark for 90 seconds also was good (470 volts), and the dark decay of the voltage (Vi-Vr/s=120 volts/90 sec.=1.3 V/s) appeared to satisfactory, the photoreceptor layer was found to be cracked at the end of the 48 hour hold period, and the layer cracked further on filming, thus demonstrating the need for a plasticizer to prevent such cracking.

The plasticizers selected for evaluation fell into four general classes: (1) dialkyl phthalates, more be specifically, dibutylphthalate (DBP), dioctylphthalate (DOP), and diundecylphthalate (DUP); (2) dialkyl adipates, i.e., [di-2-ethyl hexyl adipate (marketed as Plastolein-9066, from Quantum Chemical Corp., Cincinnati, Ohio); (3) di-2-ethyl hexyl azelate (marketed as Plastolein-9058, also from Quantum Chemical Corp.); and (4) terpene resins (marketed as Cumar-21, from Neville Chemical Co., Pittsburgh, Pa.). The materials of classes 2 and 4 correspond to materials known in the prior art and the material of class 3 is related to class 2. None of the materials in classes 2 through 4 is included within the group of diesters of phthalatic acids recited in class 1.

Again with reference to the TABLE, with the exception of the sample 2 (5 wt % DOP), samples 3 through 9, representing plasticizer concentrations of 10 to 30 wt %, showed no cracking of the photoreceptor layer (i.e., layer 34) when held at 75% RH for 48 hours. The charge acceptance, i.e., the initial voltage, Vi, on samples 3 through 9, as well as the voltage remaining after a 90 second dark hold, Vr, decreased with increasing concentrations of plasticizer. Only samples 4, 5 (both DOP) and 7 (DUP) were filmed since it was believed that the higher concentrations of plasticizers, i.e., from 20 to 30 wt % of the PVK, would provide the necessary flexibility to the photoreceptor layer. The charge acceptance and retention of the DOP and DUP samples exceeded that of the DBP samples so that the two former materials in concentrations of 10 to 30 wt % and 10 to 20 wt % were preferred over the two DBP samples (8 and 9); although, DBP was an acceptable material. Samples 10 and 11 (Plastolein-9066) were unacceptable for use in the "dry" process described herein because of cracking (sample 10) of the photoreceptor layer, or no light sensitively of the layer, at a plasticizer concentration of 20 wt % (sample 11). Sample 12 also was unacceptable since a 10 wt % concentration of Plastolein-9058 exhibited no light sensitivity. While samples 13 and 14 exhibited outstanding charge acceptance (Vi) and charge retention (Vr) ability, both samples, utilizing 10 and 20 wt % concentration of Cumar-21, exhibited cracks in the photoreceptor layer after the 48 hour hold at 75% RH.

What is claimed is:

1. In a method of electrophotographically manufacturing a luminescent screen assembly on an interior surface of a faceplate panel for a color CRT comprising the steps of:

a) forming a volatilizable conductive layer on said surface of said panel;

b) overcoating said conductive layer with a photoconductive solution, said solution comprising about 3.0 to 7.0 weight percent of a volatilizable organic polymeric material, about 0.1 to 0.4 weight percent, relative to said organic polymeric material, of a dye sensitive to visible light, a suitable concentration of a plasticizer, and the balance, a solvent, to form a volatilizable photoconductive layer;

c) establishing a substantially uniform electrostatic charge on said photoconductive layer;

d) exposing selected areas of said photoconductive layer to visible light to affect the charge thereon;

e) developing said photoconductive layer with at least one dry light-emitting, triboelectrically charged, screen structure material;

f) bonding said screen structure material to said photoconductive layer;

g) fixing the resultant structure to minimize displacement of said screen structure material;

h) filming said screen structure material;

i) aluminizing the filmed screen structure material; and j) baking said faceplate panel in air at a temperature of about 425° C. to volatilize the constitutents of the screen assembly, including said conductive layer, said photoconductive layer, and the solvents present in both the screen structure and filming materials, the improvement wherein said plasticizer being a dialkyl phthalate selected from the group consisting of dibutylphthalate (DBP), dioctylphthalate (DOP), and diundecylphthalate (DUP), said plasticizer having a concentration within the range of 10 to 30 weight percent of said organic polymeric material.

2. The method of claim 1, wherein said plasticizer having a concentration within the range of 20 to 30 weight percent of said organic polymeric material.

* * * * *

UNITED STATES PATENT AND TRADEMARK OFFICE

CERTIFICATE OF CORRECTION

PATENT NO. : 5,135,826

DATED : Aug. 4, 1992

INVENTOR(S) : Peter Michael Ritt et al.

It is certified that error appears in the above-identified patent and that said Letters Patent is hereby corrected as shown below:

Col. 6, line 46, after "to" add --be--.

Col. 6, line 52, after "more" delete "be".

Col. 8, line 22, change "constitutents" to --constituents--.

Signed and Sealed this

Thirty-first Day of August, 1993

Bruce Lehman

*Attest:*

BRUCE LEHMAN

*Attesting Officer*

*Commissioner of Patents and Trademarks*